US005531089A

United States Patent [19]

Nikaido et al.

[11] Patent Number: 5,531,089

[45] Date of Patent: Jul. 2, 1996

[54] SHEET CROWN CONTROL METHOD AND ROLLING EQUIPMENT LINE FOR ENDLESS ROLLING

[75] Inventors: Hideyuki Nikaido; Nobuaki Nomura; Toshisada Takechi; Yoshimitsu Fukui; Masanori Kitahama; Kunio Isobe; Norio Takashima, all of Chiba, Japan

[73] Assignee: Kawasaki Steel Corporation, Hyogo, Japan

[21] Appl. No.: 237,050

[22] Filed: May 3, 1994

[30] Foreign Application Priority Data

May 7, 1993 [JP] Japan ..... 5-106741
Jan. 26, 1994 [JP] Japan ..... 6-007003

[51] Int. Cl.[6] ..... B21B 1/24

[52] U.S. Cl. ..... 72/241.8; 72/366.2; 228/158

[58] Field of Search ..... 72/206, 234, 241.2, 72/241.8, 245, 365.2, 366.2; 228/158

[56] References Cited

U.S. PATENT DOCUMENTS 4,805,492 2/1989 Tsuruda ..... 72/234
4,864,836 9/1989 Ochiai ..... 72/234
5,121,873 6/1992 Sekiya et al. ..... 72/234
5,219,114 6/1993 Kajiwara et al. ..... 72/234
5,365,764 11/1994 Kajiwara et al. ..... 72/234

FOREIGN PATENT DOCUMENTS 62-3818 1/1987 Japan .
4-262804 9/1992 Japan .

*Primary Examiner*—Lowell A. Larson
*Assistant Examiner*—Thomas C. Schoeffler
*Attorney, Agent, or Firm*—Oliff & Berridge

[57] ABSTRACT

A sheet crown control method and apparatus for use in endless rolling in which consecutively fed sheets are joined to each other to be continuously rolled through a rolling equipment line. The rolling equipment line includes a junction device for joining consecutively fed sheets to each other, a plurality of stands arranged in tandem on the downstream side of the junction device and having a roll bender load adjusting mechanism and a roll crossing mechanism. The roll cross angle of rolls incorporated in a stand of each rolling mill is set at a predetermined value beforehand if there is a roll cross angle that will enable a target sheet crown to be applied to each sheet and the roll bender load of each stand is adjusted on-line, thereby effecting sheet crown control. Rolling also may be performed while adjusting the roll cross angle of rolls incorporated in stands of each rolling mill on-line together with the roll bender load. The roll bender load and the roll cross load may be adjusted in a transition region where a junction between sheets exists or in a stationary region where sheets of the same material follow one after another.

11 Claims, 6 Drawing Sheets

SHEET CROWN CONTROL METHOD AND ROLLING EQUIPMENT LINE FOR ENDLESS ROLLING

BACKGROUND OF THE INVENTION

1. Field of the Invention

The present invention relates to a method and rolling equipment line for use in endless rolling, in which the trailing edge of a sheet being fed and the leading edge of another sheet subsequent thereto are joined to each other on the input side of hot rolling equipment to continuously roll the sheets, the method and rolling equipment line quickly imparting an appropriate sheet crown to each sheet independently of changes in sheet thickness, sheet width or sheet material.

2. Description of the Related Art

Endless rolling, in which the trailing edge of a sheet being fed and the leading edge of another sheet subsequent thereto are joined to each other on the input side of hot rolling equipment to continuously roll the sheets, is advantageous in that any trouble caused during sheet passage can be reduced and that a substantial expansion of rolling limit can be expected (See Japanese Laid-Open Patent Application No. 4-262804).

As disclosed in Japanese Laid-Open Patent Application No. 62-3818, in sheet crown control for a rolling system as described above, errors in sheet thickness or anticipated load errors are generally ascertained at each stand of rollers and, on the basis of the errors thus ascertained, the load of the roll bender is adjusted, thereby attaining the target sheet crown.

However, this endless rolling, described above, has the following problem:

If the sheets to be joined together are made of the same material and have the same thickness, it is possible to continue rolling without any change in the set conditions for the rolling mill. In reality, however, the material and size of products to be obtained through hot rolling varies greatly. That is, the sheets to be rolled are not always of the same material or size.

To make the most of endless rolling, sheets of different materials and sizes have to be joined to each other.

To impart a desired sheet crown to each sheet to be rolled, it is necessary to change, during the feeding of the sheets, the mechanical crown to be imparted by the upper and lower work rolls so as to keep the mechanical crown of each sheet in conformity with a target sheet crown value, in accordance with changes in rolling load and changes in the target crown for each sheet.

However, the conventional technique of changing the roll bender load for the purpose of changing the mechanical crown is disadvantageous in that the control range is very small.

Generally speaking, it is only possible for the roll bender to apply a force which is within approximately ±120 t of the stress limit of the roll chock, and the amount of change of the mechanical crown in this case is as small as approximately 600 μm.

SUMMARY OF THE INVENTION

This invention provides a sheet crown control method for use in endless rolling in which consecutively fed sheets are joined to each other and continuously rolled through a rolling equipment line having a plurality of rolling mills.

The roll cross angle of a roll incorporated in a stand of each rolling mill is set at a predetermined value before the joined sheets are rolled and the roll bender load of each stand is adjusted on-line, thereby imparting a predetermined crown to each sheet. This invention also performs rolling while adjusting on-line the roll cross angle of a roll incorporated in a stand of each rolling mill together with a roll bender load.

Further, in accordance with this invention, the roll bender load is adjusted and the roll cross angle is adjusted in a transition region in which a sheet junction exists or in a stationary region in which sheets of the same material follow one after another. During the adjustment of the roll bender load or roll cross angle in the stationary region, it is expedient to keep the mechanical crown constant. Further, it is advantageous from the viewpoint of improving production efficiency to perform rolling of the sheets while joining to each other sheets of different materials whose width, thickness, etc. vary or sheets of the same material whose width, thickness, etc vary.

Further, in accordance with the present invention, there is provided a rolling equipment line comprising a junction device for joining consecutively fed sheets to each other, and a plurality of stands arranged in tandem on the downstream side of the junction device. The equipment line has a roll bending mechanism, a roll crossing mechanism and means for setting the roll cross angle and the roll bender load of each of the stands so that a predetermined sheet crown is applied to each of the sheets.

Further in accordance with this invention, there is provided a sheet crown control method for endless rolling in which consecutively fed sheets are joined to each other to be continuously rolled through a rolling equipment line having rolls incorporated in each of a plurality of stands, the sheet crown control method comprising the steps of:

determining a roll cross angle range for each of the sheets, the roll cross angle range including roll cross angles that would enable a target sheet crown to be imparted with respect to each of the sheets to be continuously rolled; and effecting crown control for each of the sheets as follows:

when there is a common roll cross angle common to the roll cross angle range of all the sheets to be continuously rolled, setting the roll cross angle to the common roll cross angle with respect to each of the stands to set the sheet crown of each of the sheets to the target sheet crown, and when there is no common roll cross angle common to the roll cross angle range of all the sheets to be continuously rolled, setting the roll cross angle for each of the stands with a value within the roll cross angle range for each of said sheets prior to a respective one of said sheets being rolled; and adjusting the roll bender load for each of said stands to set the sheet crown of each of said sheets to the target sheet crown.

DETAILED DESCRIPTION OF THE INVENTION

Figure 1A:
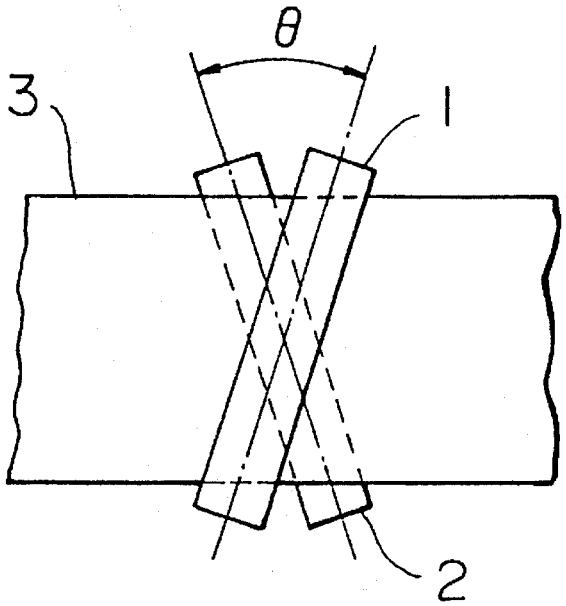
FIGS. 1A and 1B are diagrams showing the roll cross angle θ of a cross rolling mill.
Figure 1B:
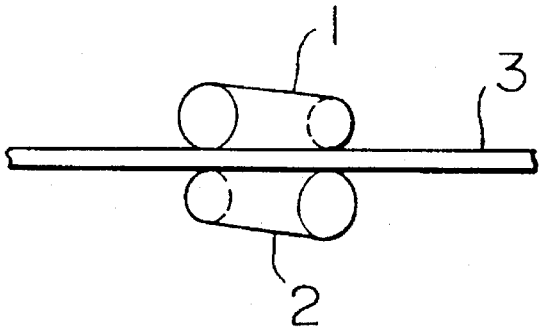

As shown in FIGS. 1A and 1B, the roll cross angle θ of upper and lower work rolls 1 and 2, incorporated in a stand is defined as the angle made between the roll axes of the upper and lower work rolls 1 and 2 holding a sheet 3 therebetween, when these axes cross each other. Mechanisms for setting the roll cross angle are well known and available. Accordingly, such a mechanism is not shown in the drawings.

A rolling mill that imparts a roll cross angle θ to upper and lower work rolls is called a cross rolling mill. Mechanisms for setting the roll bender load are well known and available. Accordingly, such a mechanism is not shown in the drawings.

Figure 2:
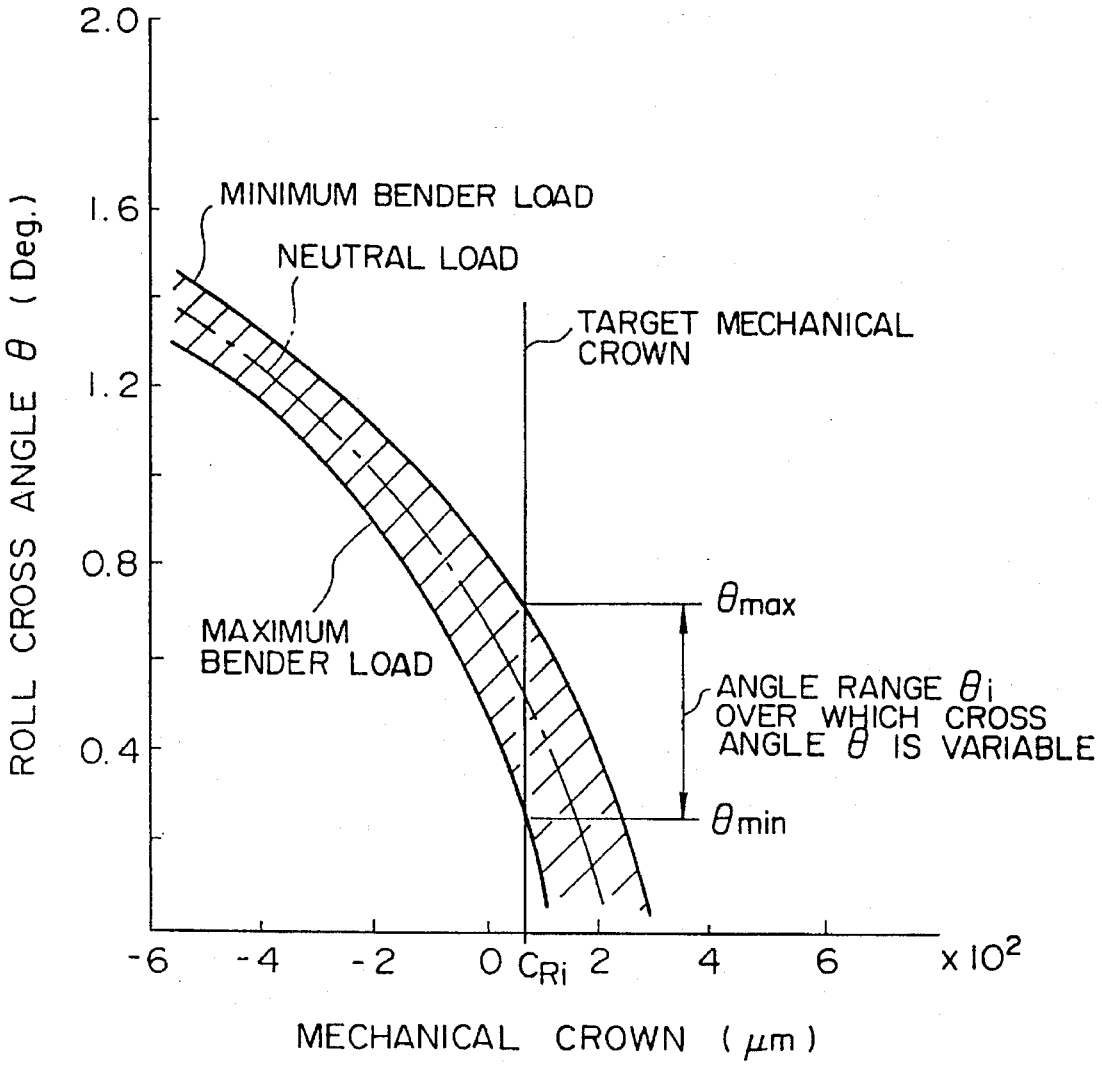
FIG. 2 is a diagram showing the relationship between roll cross angle and mechanical crown.

FIG. 2 is a diagram showing a mechanical crown control range in a cross rolling mill when conditions are given regarding sheet thickness, sheet width, rolling load, etc.

In FIG. 2, the upper part of the curve represents a case in which a minimum roll bender load is applied to the upper and lower work rolls, indicating the minimum value in mechanical crown control by the roll bender.

The lower part of the curve represents a case in which a maximum roll bender load is applied to the upper and lower work rolls, indicating the maximum value in mechanical crown control by the roll bender.

FIG. 2 further shows an angle range in which the cross angle θ can be set to provide a target crown CRi as the bender load is varied between minimum and maximum values. The cross angle θ is to be used in setting a target mechanical crown CRi.

Assuming that, when rolling a material, a target sheet crown Chi is set in an arbitrary one of a plurality of stands, the target sheet crown Chi can generally be expressed by the following equation:

$$Chi=\alpha i\times Cri+(\beta i\times Chi-1)$$

where αi indicates a transfer rate of the sheets; βi indicates a hereditary coefficient of the sheets; and CRi indicates a target mechanical crown.

Therefore, the target mechanical crown CRi can be obtained by the following equation:

$$CRi=(Chi-\beta i\times Chi-1)/\alpha i$$

FIG. 2 shows a control range for the target mechanical crown CRi thus calculated based on the range of bender loads.

To obtain the target mechanical crown CRi, it is only necessary to adjust the roll bender load between the maximum roll bender load and the minimum roll bender load and the roll cross angle θ between the maximum (θmax) and the minimum (θmin) of the corresponding roll cross angle θ.

The maximum value θmax and the minimum value θmin of the roll cross angle θ, i.e., the range in which the roll cross angle θ can be set, are determined by the thickness, width, material, etc. of the sheets to be rolled.

In accordance with the present invention, the angle range in which the cross angle θi can be set is obtained with respect to each of the sheets to be continuously rolled. The cross angle and load bender calculations may be done by an ordinary, generally available computer, for example, which is coupled to the roll cross angle setting mechanism and to the roll bender load setting mechanism to control their settings.

Figure 3:
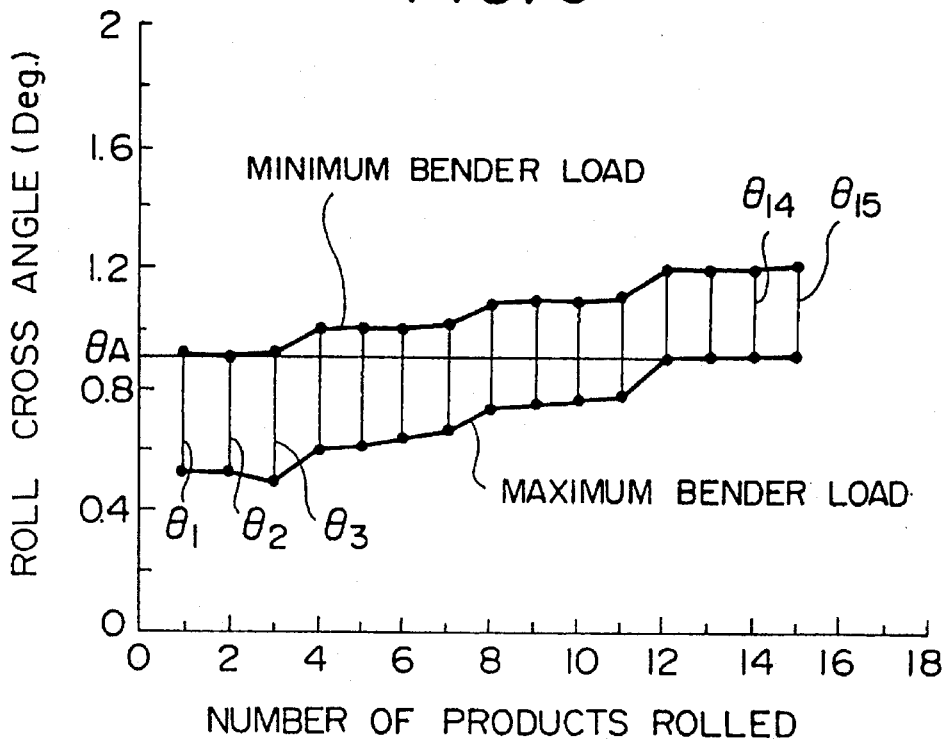
FIG. 3 is a diagram showing the relationship between roll cross angle and bender load.
Figure 4:
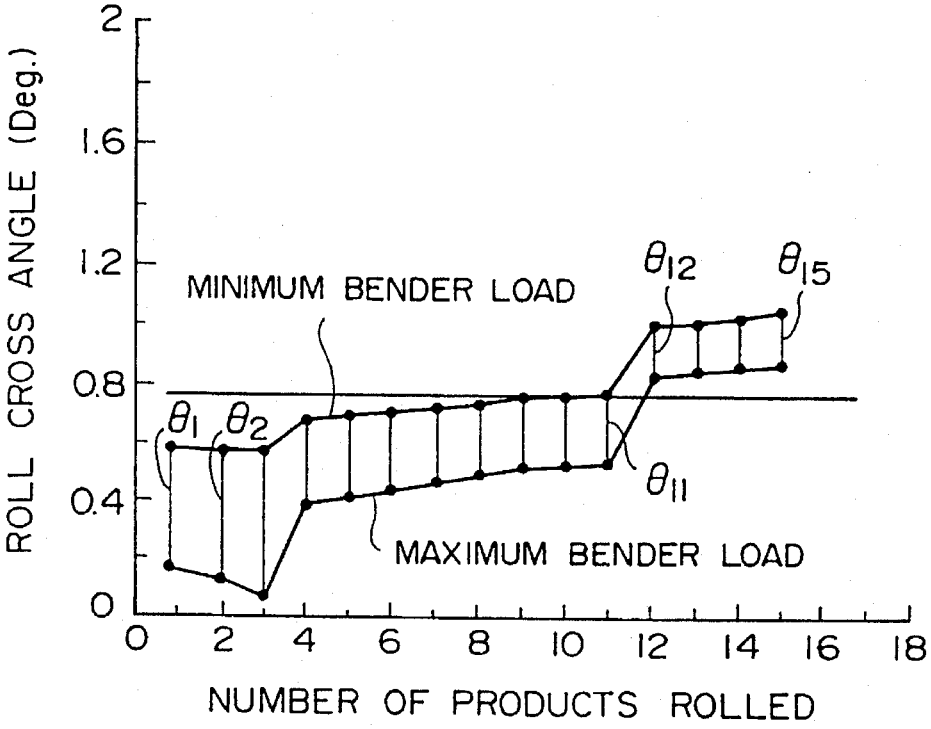
FIG. 4 is a diagram showing the relationship between roll cross angle and bender load.

An example of this process is shown in FIGS. 3 and 4.

In both FIGS. 3 and 4, the number of sheets to be continuously rolled is fifteen, and the roll cross angles θ1–θ15 are respectively obtained for these sheets.

FIG. 3 shows a case in which there is a roll cross angle θA that is common to all the sheets to be continuously rolled.

When such a common roll cross angle θA exists, the roll cross angle of the upper and lower work rolls 1 and 2 (See FIG. 1) is set to θA before the joined sheets are rolled.

Each time the sheets to be rolled are changed, the roll bender load of each stand may be adjusted so as to obtain the target sheet crown Chi with respect to each sheet.

FIG. 4 shows a case in which there is no range of roll cross angle θ that is common to all the sheets to be rolled.

In the example of FIG. 4, there is no common roll cross angle θ with respect to the eleventh (leading) sheet and the twelfth (trailing) sheet, for example.

In such a case, the roll cross angle θ of the twelfth (trailing) sheet is changed to an angle different from the roll cross angle θ of the eleventh (leading) sheet.

Generally speaking, the change of the roll cross angle takes place very slowly, so that an on-line sheet crown control through this change alone leads to a great loss in yields. In view of this, this invention uses a roll bender having high responsivity, allowing a change in the roll bender load to compensate for the slow change in the roll cross angle.

Figure 5A:
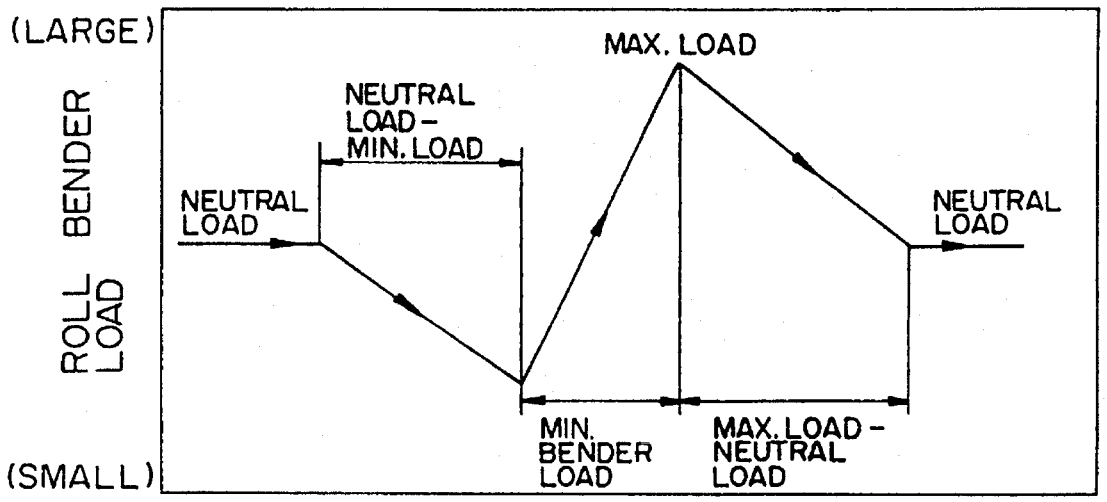
FIG. 5 is a diagram illustrating a sheet crown control method.
Figure 5B:
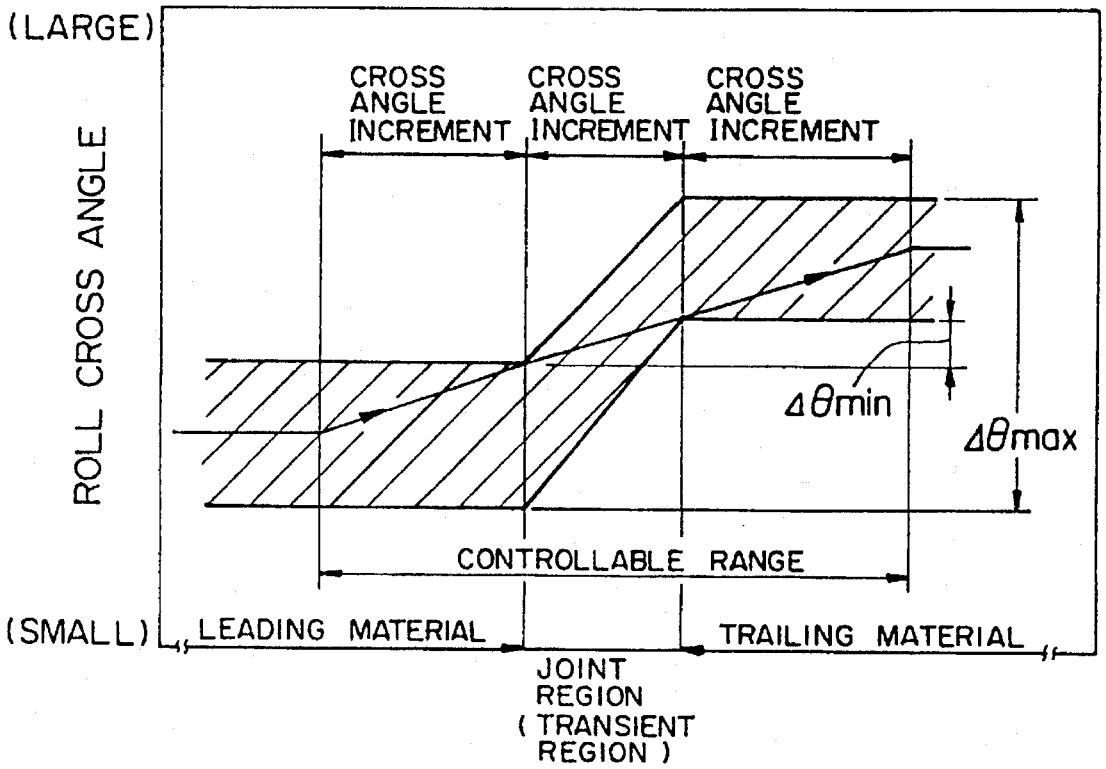
Figure 6A:
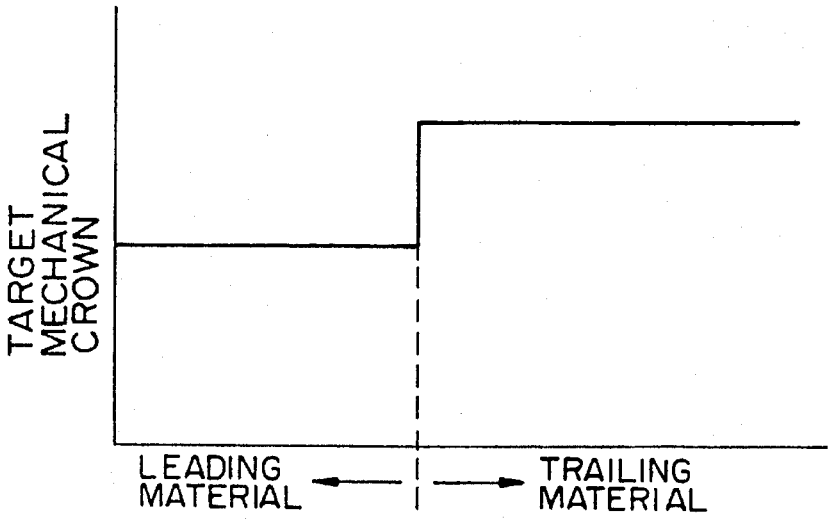
FIG. 6 is a diagram showing the results of investigation of actual mechanical crowns.
Figure 6B:
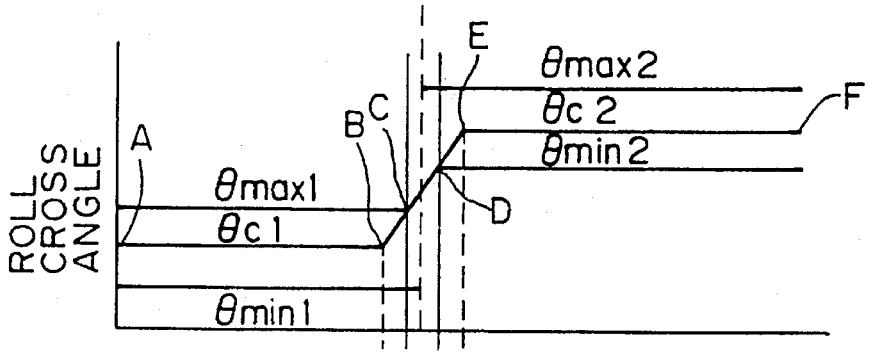
Figure 6C:
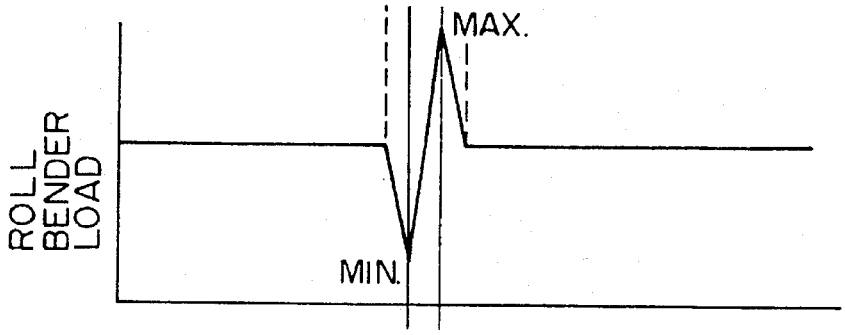
Figure 6D:
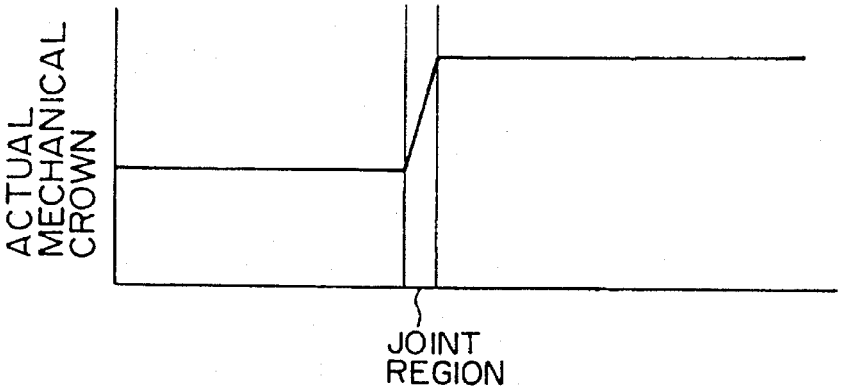

FIG. 5 shows a case in which the roll bender load and the roll cross angle θ are adjusted in the joint region between the eleventh (leading) sheet and the twelfth (trailing) sheet to impart a sheet crown Ch12 that is different from that of the eleventh (leading) sheet to the twelfth (trailing) sheet.

In this example, the sheet crown is increased.

To increase the roll cross angle θ of the stands applied to the twelfth (trailing) sheet in the example of FIG. 5, the roll cross angle θ of the stands of the rolling mill is gradually increased before the joint region between the eleventh (leading) and the twelfth (trailing) sheets has reached this rolling mill.

In this process, the roll bender load is gradually reduced with the increase of the roll cross angle θ so that the sheet crown Ch11 of the sheet being rolled will not change.

In the rolling in the stationary range, the roll bender load is generally set to a neutral load (See FIG. 2). The increase of the roll cross angle and the decrease of the roll bender load continue until the joint region between the sheets reaches the rolling mill. The increase in the roll cross angle θ takes place in the range of FIG. 2 in which the roll cross angle θ can be controlled.

Next, at the stage where the joint section of the sheets has reached the rolling mill, the roll bender load is increased in a short time to the maximum value at which the target sheet crown Ch12 can be imparted to the twelfth (trailing) sheet, whereas the roll cross angle θ continues to increase.

This joint region corresponds to the transition region where no sheet crown control is effected. It is desirable for this transition region to be as short as possible since this transition region becomes a scrap. It is desirable for the transition region to be approximately 1 second in terms of passage of one stand.

Next, when the roll bender load has been increased to the maximum value, the roll bender load is decreased gradually so that the roll bender load may become a neutral load, whereas the roll cross angle θ continues to increase so that the trailing material may attain the target sheet crown.

When the roll bender load has become a neutral load, the increase of the roll cross angle θ is terminated.

After this, the twelfth (trailing) sheet is rolled while keeping the roll cross angle θ constant.

In FIG. 5, Δθmin indicates the minimum amount of change of the roll cross angle, and Δθmax indicates the maximum amount of change of the roll cross angle.

The above example has been described with reference to the case where the roll cross angle of the stands applied to the trailing material is increased. In the case where the roll cross angle of the stands applied to the trailing material is decreased, the roll cross angle and roll bender load are adjusted in a reverse order from the order explained above in relation to FIGS. 4–5.

In the above-described control process of the present invention, the amount of change ΔCRi of the mechanical crown when the amount of change of the roll cross angle θ is Δθ can be obtained from equation (1).

$$\Delta CRi = L^2/D \times \tan\theta \times \Delta\theta \quad (1)$$

where L: roll barrel of the work rolls

D: diameter of the work rolls

θ: set roll cross angle

The amount of change ΔB of the roll bender load can be obtained from equation (2)

$$\Delta B = f\,(W, L, D, \Delta CRi) \quad (2)$$

By thus adjusting the bender load in accordance with the change in the roll cross angle θ, the mechanical crown when the leading and trailing sheets are rolled can be kept substantially constant except for the transition region including the joint region. Therefore, the scrap portion can be substantially reduced.

FIG. 6 shows the actual mechanical crown when the roll cross angle θ and the bender load are adjusted in conformity with the target mechanical crown ΔCRi so as to control the sheet crown of the leading and trailing sheets.

In FIG. 6, θmax1 indicates the requisite roll cross angle when the bender load is minimum in the rolling of the leading material; it is the maximum roll cross angle θ for the leading material.

When the roll of a stand is crossed beyond θmax1, center buckle of the trailing material occurs.

θmin1 indicates the requisite roll cross angle when the bender load is maximum in the rolling of the leading material; it is the minimum roll cross angle θ for the leading material.

θmax2 and θmin2 are values similar to the above in the rolling of the trailing material or sheet.

In the line θC1–θC2, the section AB corresponds to the stationary region (i.e., where the load and cross angle are constant).

The section BC corresponds to a region in which the target crown of the leading material can be obtained although the bender load and the roll cross angle θ are changed.

The section CD corresponds to a transition region in which the target crown of the leading or trailing sheet cannot be obtained.

The section DE corresponds to a region where the target crown of the trailing sheet can be obtained although the bender load and the roll cross angle are changed.

The section EF corresponds to the stationary region.

Figure 7:
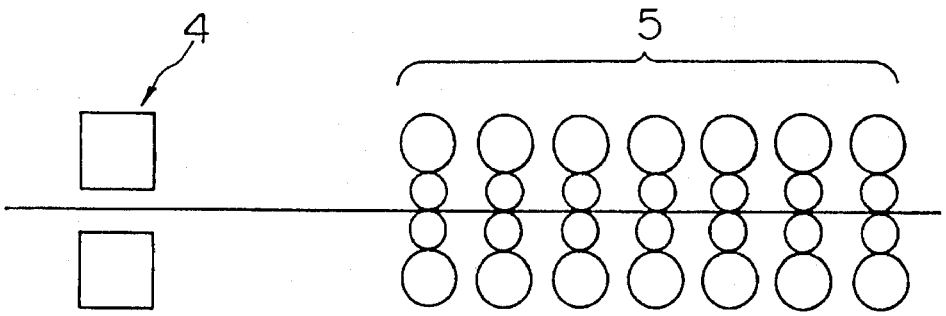
FIG. 7 is a diagram showing the construction of a rolling equipment line.

FIG. 7 shows an example of the construction of a rolling equipment line suitable for the execution of the method of the present invention. In the drawing, numeral 4 indicates a junction device for joining the trailing edge of a sheet with the leading edge of another sheet subsequent thereto in a short time; numeral 5 indicates hot rolling equipment arranged downstream from the junction device 4 and adapted to perform hot rolling continuously on sheets joined to each other. The rolling equipment 5 shown consists of seven stands arranged in tandem. The fourth through seventh stands are equipped with a roll crossing mechanism (not shown) in addition to the roll bending mechanism.

A suitable example of the rolling mill constituting the rolling equipment line shown in FIG. 7 is a so-called pair cross rolling mill consisting of a combination of a back-up roll and work rolls. However, a single-type cross rolling mill solely incorporating work rolls is also applicable. The change of the mechanical crown can also be effected through adjustment of the crown of the back-up roll.

EXAMPLE

Figure 8:
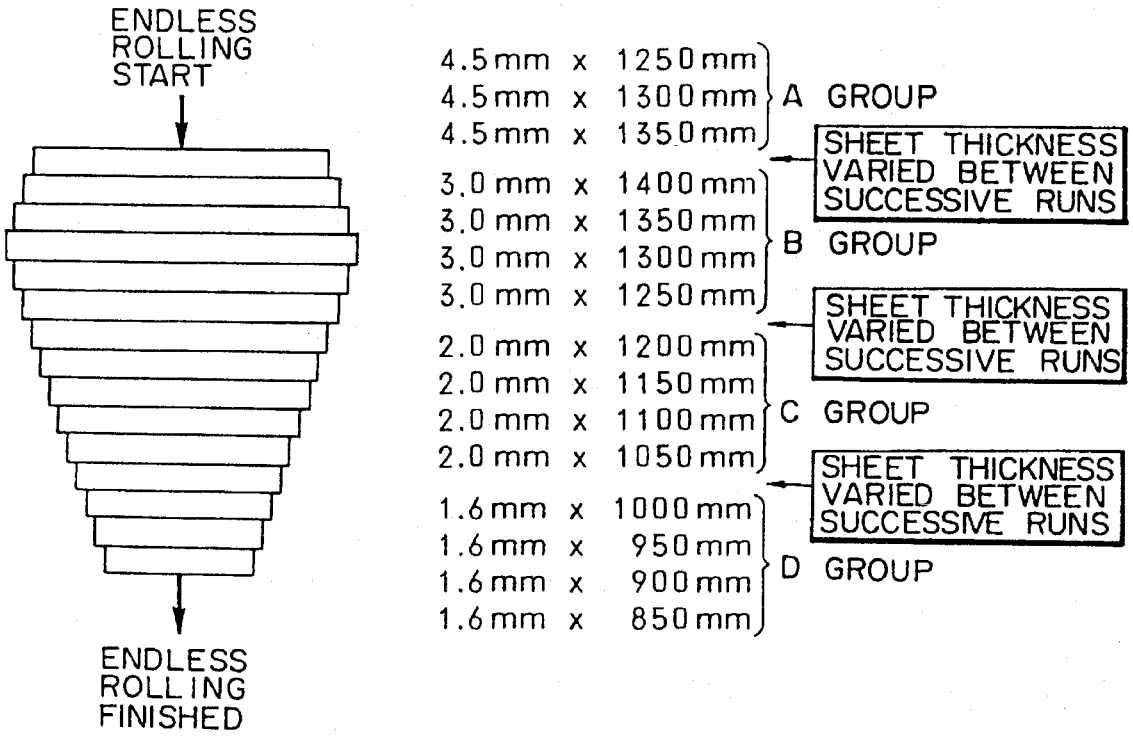
FIG. 8 is a diagram illustrating a sheet bar rolling method.

As shown in FIG. 8, the following sheet bars were prepared: three sheet bars (plain carbon steel) having a thickness of 30 mm and a width of 1250 to 1350 mm (hereinafter referred to as Group A); four sheet bars (plain carbon steel) having a thickness of 30 mm and a thickness of 1250 to 1400 mm (hereinafter referred to as Group B); four sheet bars (plain carbon steel) having a thickness of 30 mm and a width of 1050 to 1200 mm (hereinafter referred to as Group C); and four sheet bars (high tensile strength steel) having a thickness of 30 mm and a width of 850 to 1000 mm (hereinafter referred to as Group D). These sheet bars were successively joined to each other on the input side of the rolling equipment to perform endless rolling (at a rolling rate of 700 mpm throughout the process) with sheet crown control (in which the sheet thickness was changed at each transition from one group to another and in which the roll cross angle was changed in substantially the same way as in the case of FIGS. 3 and 4). The sheets thus obtained were examined for crown precision and configuration (Group A had a finish sheet thickness of 4.5 mm; Group B had a finish sheet thickness of 3.0 mm; Group C had a finish sheet thickness of 2.0 mm; and Group D had a finish sheet thickness of 1.6 mm).

Rolling was performed on Groups A through D with a properly set load and at an optimum roll cross angle. The resulting products exhibited a relatively small transition region of approximately 10 m in the case of a 1.6 mm finish sheet. With the prior-art technique, a transition region of approximately 25 m would have been generated.

In accordance with the present invention, sheet crown control is obtained independently of changes in sheet thickness, sheet width or sheet material when a plurality of consecutive sheets are joined together and continuously rolled. Further, the scrap portion, which leads to a reduction in yield, is very small. Thus, it is possible to perform efficient rolling.

We claim:

1. A sheet crown control method for use in endless rolling in which consecutively fed sheets are joined to each other and continuously rolled through a rolling equipment line having a plurality of stands, the method comprising the steps of:

determining a roll cross angle range for each sheet based on a target sheet crown corresponding to the sheet, at least two of the sheets having different roll cross angle ranges;

comparing the roll cross angle ranges for the sheets to be rolled;

determining a common roll cross angle which is within the roll cross angle range for each sheet;

setting a roll cross angle of rolls incorporated in each of said stands to the common roll cross angle; and adjusting a roll bender load of each of said stands for each of said sheets to achieve the target sheet crown for each of said sheets.

2. A method according to claim 1, wherein the sheets vary in one of a width, a thickness and a material, further comprising the step of joining the sheets to each other while the sheets are rolled.

3. A sheet crown control method for use in endless rolling in which consecutively fed sheets are joined to each other and continuously rolled through a rolling equipment line having a plurality of stands, the method comprising the steps of:

determining a roll cross angle range for each sheet based on a target sheet crown corresponding to the sheet, at least two of the sheets having different roll cross angle ranges;

comparing the roll cross angle ranges for the sheets to be rolled;

determining sets of consecutively joined sheets for which a common roll cross angle exists which is within the roll cross angle range for sheets in a set, each set of sheets having at least one sheet;

setting a roll cross angle of rolls incorporated in each of said stands equal to a first common roll cross angle for a first set of sheets to be rolled;

beginning rolling the first set of sheets;

adjusting on-line the roll cross angle of the rolls incorporated in each of said stands to a next common roll cross angle of a next set of sheets to be rolled, the roll cross angle for each stand within a roll cross angle range for a lead sheet of the next set of sheets before the lead sheet is rolled by each stand; and adjusting a roll bender load of each of said stands to achieve a target sheet crown of each of said sheets.

4. A method according to claim 3, wherein the roll bender load and the roll cross angle are adjusted in transition regions where a junction between different sets of sheets exists, or in a stationary region where sheets of a same set follow one another.

5. A method according to claim 3, wherein the crown of each of said sheets is kept constant during adjustment of the roll bender load and the roll cross angle in a stationary region where sheets of a same set are joined to each other.

6. A method according to claim 4, wherein the crown of each of said sheets is kept constant during adjustment of the roll bender load and the roll cross angle in the stationary region.

7. A method according to claim 3, wherein the sheets vary in one of a width, a thickness and a material, further comprising the step of joining the sheets to each other while the sheets are rolled.

8. A method according to claim 4, wherein the sheets vary in one of a width, a thickness and a material, further comprising the step of joining the sheets to each other while the sheets are rolled.

9. A method according to claim 5, wherein the sheets vary in one of a width, a thickness and a material, further comprising the step of joining the sheets to each other while the sheets are rolled.

10. A sheet crown control method for endless rolling in which consecutively fed sheets are joined to each other and continuously rolled through a rolling equipment line, at least two of said sheets having different roll cross angle ranges, said rolling equipment line having rolls incorporated in a plurality of stands, the rolls having an adjustable roll cross angle, said sheet crown control method comprising the steps of:

determining a roll cross angle range for each of said sheets, the roll cross angle range including roll cross angles that would enable a target sheet crown to be imparted with respect to each of the sheets to be continuously rolled; and effecting crown control for each of said sheets as follows:

when there is a common roll cross angle common to the roll cross angle range of all the sheets to be continuously rolled, setting the roll cross angle for each of said stands to the common roll cross angle to set the sheet crown of each sheet to the target sheet crown, and when there is no common roll cross angle common to the roll cross angle range of all the sheets to be continuously rolled, setting the roll cross angle for each of said stands to a value within the roll cross angle range for each of said sheets prior to rolling each of said sheets; and adjusting the roll bender load for each of said sheets to achieve the target sheet crown.

11. A rolling equipment line comprising:

a junction device that receives and joins consecutive sheets to each other, at least two consecutive sheets having different roll cross angle ranges;

a plurality of stands arranged in tandem downstream from said junction device, each of said stands having rolls for rolling said sheets;

a roll crossing mechanism connected to said rolls, the roll crossing mechanism adjusting a roll cross angle between said rolls;

a roll bender load adjusting mechanism connected to the rolls, the roll bender load adjusting mechanism adjusting a roll bender load of each of said stands; and means for setting the roll cross angle and the roll bender load of each of said stands during rolling of said sheets so that a predetermined sheet crown is applied to each of said sheets, the setting means initiating adjusting the roll cross angle during rolling so the roll cross angle is within a roll cross angle range corresponding to a sheet before the sheet is rolled.

* * * * *